US008505301B2

(12) United States Patent
Yamamoto et al.

(10) Patent No.: US 8,505,301 B2
(45) Date of Patent: Aug. 13, 2013

(54) STEAM-JET ENGINE

(75) Inventors: Yasushi Yamamoto, Kanagawa (JP); Makoto Abe, Kanagawa (JP); Yoshihiro Takei, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 564 days.

(21) Appl. No.: 12/735,105

(22) PCT Filed: Dec. 18, 2008

(86) PCT No.: PCT/JP2008/073040
§ 371 (c)(1),
(2), (4) Date: Jun. 16, 2010

(87) PCT Pub. No.: WO2009/084444
PCT Pub. Date: Jul. 9, 2009

(65) Prior Publication Data

US 2011/0107762 A1 May 12, 2011

(30) Foreign Application Priority Data

Dec. 28, 2007 (JP) ..... 2007-339445

(51) Int. Cl.
*F01K 23/06* (2006.01)

(52) U.S. Cl.
USPC ..... 60/670; 60/645

(58) Field of Classification Search
USPC ..... 60/415, 227, 645–683
See application file for complete search history.

(56) References Cited

U.S. PATENT DOCUMENTS

| | | | | |
|---|---|---|---|---|
| 4,572,943 | A * | 2/1986 | Hogfeldt | 392/396 |
| 6,565,310 | B1 * | 5/2003 | Davidow | 415/80 |
| 2009/0107145 | A1 | 4/2009 | Yamamoto et al. | |

FOREIGN PATENT DOCUMENTS

| | | | |
|---|---|---|---|
| CN | 2197461 | | 5/1995 |
| CN | 1908378 | | 2/2007 |
| JP | 59-90710 | A | 5/1984 |
| JP | 59-142404 | | 9/1984 |
| JP | 59-142405 | | 9/1984 |
| JP | 59-168205 | A | 9/1984 |
| JP | 2002-115506 | A | 4/2002 |
| JP | 2006-329036 | A | 12/2006 |

OTHER PUBLICATIONS

Chinese Office Action dated Dec. 5, 2012.

* cited by examiner

*Primary Examiner* — Thomas Denion
*Assistant Examiner* — Philip Eklem
(74) *Attorney, Agent, or Firm* — McGinn IP Law Group, PLLC

(57) ABSTRACT

A steam engine in which a liquid and a steam are jetted so that a rotor is turned by the reaction thereof, and the rotor having a well-balanced simple structure. In the steam engine, the rotor 5 having a plurality of bent flow paths 53A to 53D arranged at regular intervals therein is rotatably supported in a closed container 1 filled with the liquid being fitted onto a boss portion 11 of the closed container 1. The boss portion 11 is alternately forming slide-contact portions 11A having a steam feed port and recessed portions 11B. The steam fed into the bent flow path 53 from the steam feed port causes the liquid in the flow path to be jetted outward to rotate the rotor 5. The rotor 5 is of a point-symmetrical shape in cross section free of unbalanced weight, has no moving part, and is simple in structure. When the bent flow path 53 communicates with the recessed portion 11B, the steam remaining in the flow path is cooled and disappears, and the flow path is filled with the liquid.

11 Claims, 4 Drawing Sheets

STEAM-JET ENGINE

TECHNICAL FIELD

This invention relates to a steam engine which converts heat energy into mechanical energy such as rotational energy and, particularly, to a steam engine which is capable of efficiently converting heat energy into mechanical energy and is also suited as an engine for mounting on a vehicle.

BACKGROUND ART

Engines (heat engines) that convert heat energy into mechanical energy include internal combustion engines such as gasoline engine and diesel engine, and external combustion engines such as steam engine that executes the so-called Rankine cycle. The internal combustion engine intermittently burns the fuel in the air which is an operation fluid and converts the generated heat into mechanical energy. On the other hand, the steam engine which is an external combustion engine transfers the heat generated by the continuous combustion to the operation fluid offering such advantages that it is easy to control the burning state of the fuel and that harmful exhaust components due to the burning, such as NOx, CO, etc. are formed in small amounts. Besides, the external combustion engine can use not only the heat of combustion but also a variety of kinds of heat sources such as exhausted heat by the internal combustion engine, etc., and has excellent features such as saving energy and also from the standpoint of coping with the environment.

To utilize the above features of the steam engine, study and development have been forwarded to employ the steam engine for vehicles. For instance, JP-A-2002-115506 is disclosing a Rankine cycle unit which actuates the steam engine by using, as a source of heat, the exhausted heat from an internal combustion engine to recover the exhausted heat as mechanical energy. The steam engine unit for executing the Rankine cycle is constituted by a boiler (evaporator) for heating the operation fluid such as water, an expansion machine (steam engine) for generating power by expanding the operation fluid that is heated at a high temperature to have a high pressure, a condenser for cooling and liquefying the operation fluid after it has expanded and a circulating pump for pumping the liquefied operation fluid to the boiler. A turbine is, usually, used as the expansion machine.

The turbine which is a steam engine is a so-called velocity-type engine that utilizes velocity energy, and is equipped with many blades on which the steam of a high speed acts. To efficiently operate the turbine, it is necessary to increase the rotational speed of the turbine so that the peripheral speed of the blades increases to a value that meets the velocity of the steam. Therefore, the turbine becomes a complex engine that operates at high speeds. Besides, the steam engine unit is provided with a boiler, a condenser and the like; i.e., the steam engine unit tends to become a facility which is large in scale.

Under such circumstances, the present applicant has developed a compact steam engine unit that efficiently operates even at low speeds as disclosed in JP-A-2006-329036. According to this steam engine unit as shown in FIG. 4, a rotor 103 having a bent jet pipe 102 is rotatably supported in a closed container 101 filled with the operation fluid in a liquid state. The rotor 103 is provided with an intake pipe 104, and a heating unit 105 is inserted in a central cylinder at the center of the rotor to thereby constitute a boiler. The operation fluid in the liquid state taken in through the intake pipe 104 is vaporized in the heating portion 105 to produce a steam which is jetted from the jet pipe 102 in a state of being mixed with the liquid to rotate the rotor 105 clockwise. The jetted steam is guided into a condenser 106 installed over the closed container 101, and is condensed and is refluxed into the closed container 101. In order to control the jet and intake of the operation fluid, a jet check valve 107 and an intake check valve 108 are disposed at the end portions of the jet pipe 102 and the intake pipe 104, respectively.

In the steam engine of FIG. 4, the rotor having the jet pipe is provided in the closed container filled with the liquid, the steam of a high pressure vaporized by the heating unit at the center of the rotor is jetted from the jet pipe in the state of a mixture of the liquid and the steam, and the rotational force is obtained by the reaction thereof. The jetted mixture contains much liquid and its mass is far greater than that of the steam. Therefore, the rotational torque of the rotor becomes very larger than that of the case of when the steam only is jetted. Accordingly, a large torque is obtained even when the rotor rotates at low speeds and, hence, the steam engine can be efficiently operated even at low speeds. Besides, the boiler and the condenser are fabricated integrally with the closed container, and the steam engine unit as a whole is compact in size.

Patent document 1: JP-A-2002-115506
Patent document 2: JP-A-2006-329036

DISCLOSURE OF THE INVENTION

Problems that the Invention is to Solve

The steam engine of FIG. 4 developed by the present applicant features excellent efficiency even at low rotational speeds and is compactly constituted. However, the jet pipe and the intake pipe provided in the rotor have different functions, and the jet check valve and the intake check valve are attached to the end portions thereof, respectively. The rotor that is statically or dynamically unbalanced generates vibration when it rotates. By employing the jet pipe and the intake pipe having different functions, however, it is difficult to maintain balance of the rotor by adjusting their weights to be equal to each other. Besides, the jet check valve and the intake check valve attached to the jet pipe and to the intake pipe include moving parts that may become faulty or defective, and require such toils as check and maintenance as well as expenses.

In the steam engine unit, the operation fluid in the liquid state is heated in the boiler and is transformed into the steam which acts on the expansion machine to generate power. Usually, therefore, an extended period of time is required before starting, and follow-up performance to a change in the load becomes inferior to that of internal combustion engines. It is required that the engine mounted on a vehicle has good starting performance and load following capability. To utilize the steam engine unit for the vehicles, therefore, it is desired to improve the starting performance.

The problem according to the invention is to provide an excellently balanced rotor of a very simple constitution for use in a steam engine body that is used as the expansion machine in the steam engine unit in an attempt to improve starting performance and like performances of the steam engine unit.

Means for Solving the Problems

In view of the above problem, the steam engine unit of the invention uses a rotor having a plurality of bent flow paths arranged at regular intervals in a simple structure without unbalanced weight, the rotor being contained and supported in a closed container filled with a liquid so as to be rotated by the steam generated in the boiler while enabling the liquid to be smoothly fed into the flow paths of the rotor. That is, according to the present invention, there is provided "a steam engine unit comprising a closed container filled with a liquid, a rotor dipped in the liquid in the closed container and is rotatably supported therein, and a boiler that heats the liquid in the closed container to generate steam, wherein:

the rotor has an inner circumferential surface formed in a round shape in cross section and a plurality of bent flow paths extending from the inner circumferential surface to an outer circumferential surface, the plurality of bent flow paths being evenly arranged in the circumferential direction of the rotor;

the closed container has a boss portion fixed to the side wall thereof and is protruding into the closed container, and the inner circumferential surface of the rotor is fitted onto the boss portion so that the rotor is rotatably supported thereby; and the outer circumference of the boss portion alternately forms slide-contact portions on where the inner circumferential surface of the rotor slides in contact therewith, and recessed portions from where the inner circumferential surface of the rotor separates away, the slide-contact portions being provided with a steam feed port for introducing the steam generated in the boiler into the rotor".

As described in claim 2, it is desired that a circulating pump is provided to feed the liquid in the closed container to the boiler, an injection nozzle is provided in the boiler, and the liquid in the closed container is injected in an atomized form into the boiler.

As described in claim 3, further, it is desired that a condenser is provided being communicated with the closed container to condense the steam.

Effects of the Invention

The steam engine unit of the invention includes the rotor that is rotatably supported in the closed container filled with the liquid, and wherein the liquid in the plurality of bent flow paths formed in the rotor is jetted from the flow paths in the form of a mixture of the liquid and the steam due to the steam generated in the boiler, and the rotor rotates by the reaction thereof. The jetted mixture contains much liquid and its mass is far greater than that of the steam. Like the steam engine shown in FIG. 4, therefore, a large torque is obtained even at the time when the rotor rotates at low speeds. Therefore, the steam engine body of the invention efficiently operates even at low speeds.

The rotor in the steam engine body of the present invention has the inner circumferential surface formed in a round shape in cross section, and has the plurality of bent flow paths evenly arranged in the circumferential direction of the rotor and extending from the inner circumferential surface to the outer circumferential surface. The rotor has no moving part such as check valve, and features a simple structure and high reliability, and is free from inconvenience that may be caused by the effect of centrifugal force during the rotation. Further, plurality of bent flow paths are evenly arranged in the circumferential direction of the rotor which, therefore, has a point-symmetrical shape in transverse cross section without any unbalanced weight. Therefore, the rotor of the invention has excellent static or dynamic balance.

Moreover, the rotor of the invention is rotatably supported being fitted onto the boss portion that is fixed to the side wall of the closed container, and the outer periphery of the boss portion is alternately forming slide-contact portions on where the inner circumferential surface of the rotor slides in contact therewith and recessed portions from where the inner circumferential surface of the rotor separates away. The slide-contact portions are provided with a steam feed port for introducing the steam generated in the boiler into the rotor. When the bent flow path of the rotor is opened to the steam feed port, the steam flows into the bent flow path and is jetted from the outer periphery of the rotor together with the liquid in the flow path to impart a rotational torque to the rotor.

As the rotor rotates and the communication is interrupted between the bent flow path and the steam feed port, the liquid in the surrounding flows reversely into the bent flow path through the opening on the outer circumferential side of the rotor imparting torque to the rotor in a direction in which the rotational torque increases. Here, the steam remaining in the bent flow path is liquefied upon being cooled by the surrounding liquid of a low temperature. Here, if the cooling is not sufficient, the rotor rotates with the steam remaining therein, and the bent flow path is opened to the steam feed port again. The liquid, therefore, is jetted in decreased amounts and only a decreased rotational torque is produced. According to the present invention, recessed portions are formed in the outer circumference of the boss portion onto which the rotor is fitted and after the communication is interrupted between the bent flow path and the steam feed port accompanying the turn of the rotor, the bent flow path opens in the recessed portion. The liquid of a low temperature is present in the recessed portions and, therefore, the remaining steam is cooled thereby and, besides, the steam partly flows into the recessed portion, and the steam remaining in the bent flow path substantially disappears. As a result, when the bent flow path opens to the steam feed port again, the interior of the flow path has been filled with the liquid, and the steam engine operates efficiently.

The invention of claim 2 is concerned to the steam engine unit, wherein a circulating pump is provided to feed the liquid in the closed container to the boiler, an injection nozzle is provided in the boiler, and the liquid is injected in an atomized form into the boiler. Usually, the operation fluid is continuously fed in the liquid state into the boiler of the steam engine unit and is transformed into the steam upon being heated. However, a considerable period of time is necessary to evaporate the liquid that is continuously fed, and the starting time is prolonged before power is generated. According to the invention of claim 2, the liquid is injected in an atomized form into the boiler from the injection nozzle provided in the boiler, and the time for evaporating the liquid is greatly shortened. Therefore, start performance of the steam engine unit is improved, quick response is attained even when the load has increased, and characteristics required for the vehicle can be satisfied.

The invention of claim 3 is concerned to the steam engine unit of the present invention, wherein a condenser is provided being communicated with the closed container to condense the steam. The closed container of the present invention is placed in the atmosphere and radiates heat to the surrounding. Therefore, the closed container itself can be used as a so-called low heat source. Upon providing a condenser communicated with the closed container and introducing the steam in the closed container to the condenser, however, the steam can be efficiently condensed and the efficiency of the steam engine unit as a whole can be improved.

DESCRIPTION OF REFERENCE NUMERALS

1—closed container
11—boss portion
12—steam introduction passage
12B—steam feed port
2—condenser
5—rotor
51—inner circumferential surface
52—outer circumferential surface
53(A to D)—bent flow paths
6—boiler
61—injection nozzle
7—circulating pump

BEST MODE FOR CARRYING OUT THE INVENTION

Figure 1:
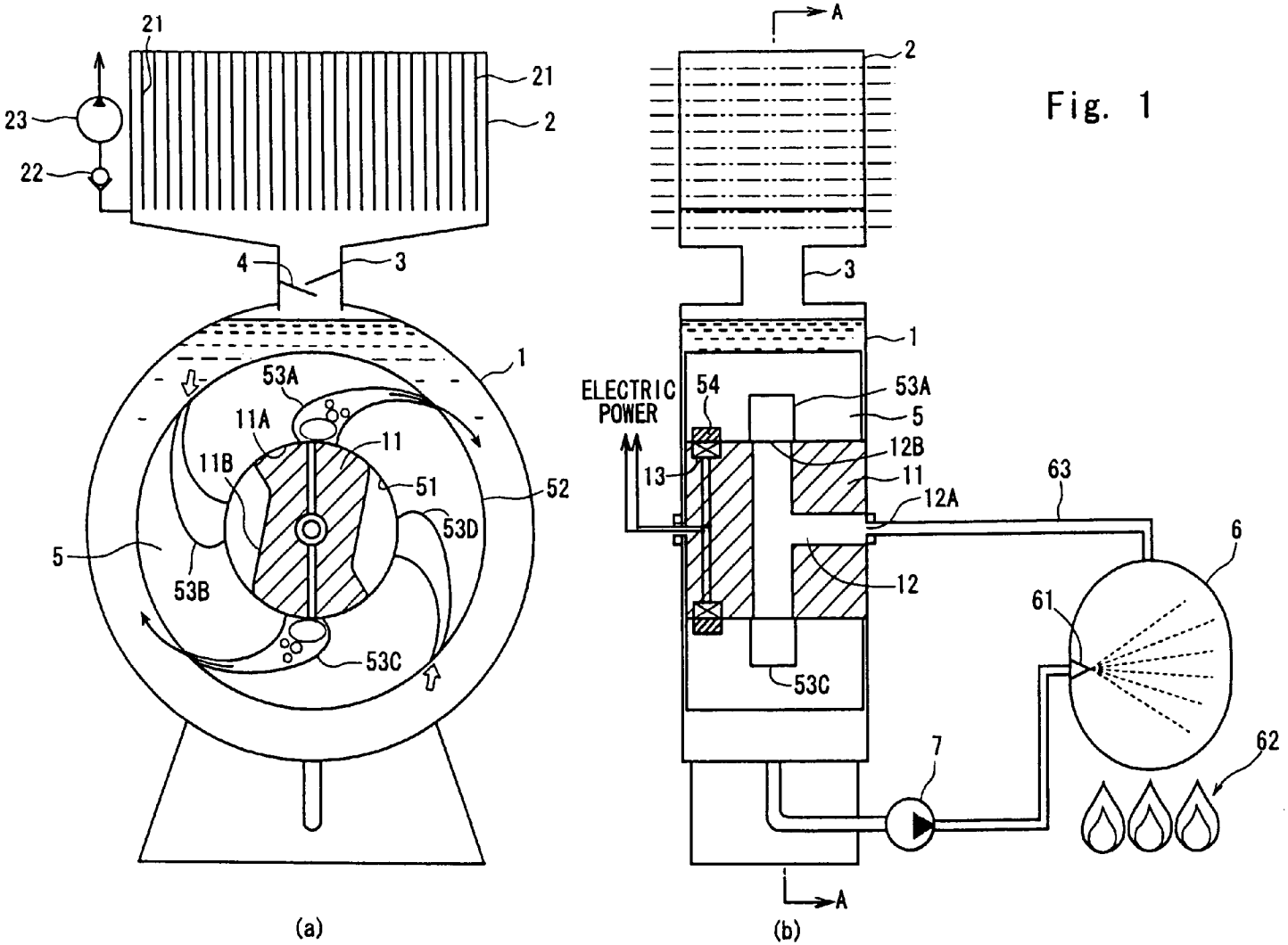
[FIG. 1] includes a whole view and a sectional view showing a steam engine unit of the present invention.
Figure 2:
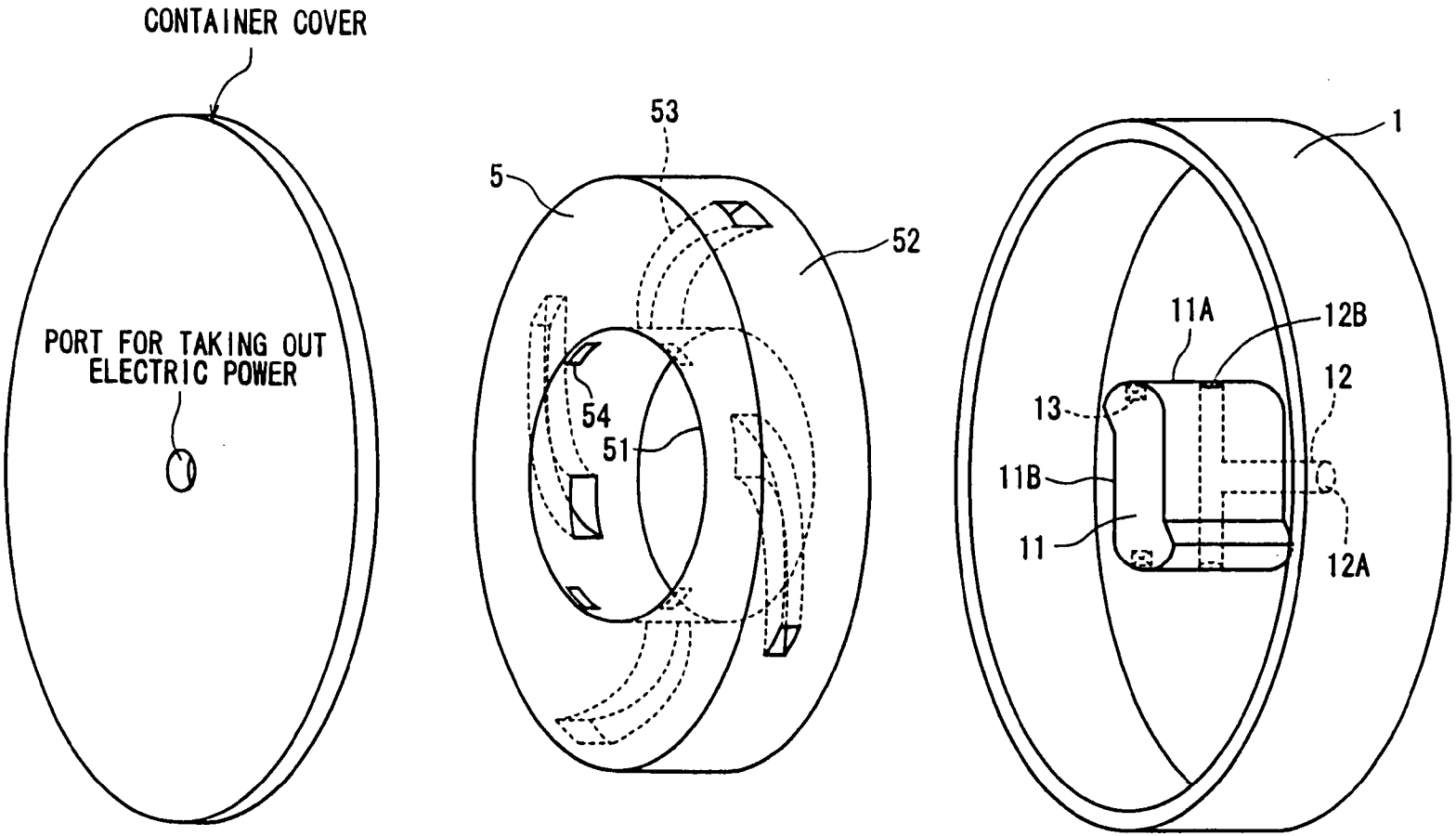
[FIG. 2] is a perspective view showing principal parts of the steam engine body of the invention.

An embodiment of the invention will now be described in detail with reference to the drawings. FIG. 1 is a view of a whole steam engine unit of the present invention, wherein FIG. 1 (*a*) shows, in transverse section, a steam engine body in the steam engine unit and FIG. 1(*b*) shows the whole unit inclusive of boiler and the like. FIG. 1(*a*) is an A-A sectional view of FIG. 1(*b*). FIG. 2 is a disassembled perspective view showing principal parts of the steam engine body.

The steam engine unit has a closed container 1 of a round shape in cross section, and contains sealed therein water as a liquid (operation fluid) that is to be heated, the water nearly filling the interior of the closed container 1. In this embodiment, a condenser 2 is provided over the closed container 1 to condense the steam, and is coupled to the closed container 1 through a short pipe 3. In the short pipe 3, a plurality of baffle boards 4 are attached maintaining a gap preventing water in the liquid state from entering into the condenser 2 but permitting the condensed water to be refluxed from the condenser 2 into the closed container 1.

In the closed container 1 of the round shape in cross section, a rotor 5 is provided being dipped in water. The rotor 5 has an inner circumferential surface 51 formed in a round shape in cross section and four bent flow paths 53A to 53D extending from the inner circumferential surface 51 to the outer circumferential surface 52, the bent flow paths 53A to 53D being evenly arranged in the circumferential direction of the rotor 5 maintaining a gap of 90°. In this embodiment, the bent flow paths 53 are of a shape that becomes narrow toward the outer circumferential surface 52. However, the flow paths 53 may have a same area in cross section over the whole length thereof. The closed container 1 has a boss portion 11 that is fixed to the side wall thereof and protrudes into the closed container 1. The rotor 5 has its inner circumferential surface 51 fitted onto the boss portion 11, and is so supported as to rotate in the closed container 1.

On the outer circumference of the boss portion 11 fixed to the side wall of the closed container 1 as shown in FIGS. 1 and 2, there are alternately formed slide-contact portions 11A on which the inner circumferential surface 51 of the rotor 5 slides in contact therewith and recessed portions 11B separated away from the inner circumferential surface 51, the slide-contact portions 11A being arc shaped in cross section. A steam introduction passage 12 is provided in the boss portion 11. The steam introduction passage 12 has a steam inlet 12A that is fed with the steam from the boiler 6, and steam feed ports 12B opened in the slide-contact portions 11A to feed steam to the rotor 5. At the end portion of the boss portion 11 on the side opposite to the steam inlet 12A, a generator coil 13 is arranged along the outer circumference thereof, and permanent magnets 54 are buried in the inner circumferential surface 51 of the rotor 5 facing the generator coil 13.

By the side of the closed container 1, there are disposed a boiler 6 that heats water in the closed container 1 to generate the steam, and a circulating pump 7 for pumping water in the closed container 1 to the boiler 6. The boiler 6 has an injection nozzle 61 for injecting water onto the inner wall of the boiler, and water in the closed container 1 pressurized by the circulating pump 7 is fed into the boiler 6 in an atomized form. The boiler 6 is provided with a heating portion 62 that burns a fuel. However, the boiler 6 may be installed, for example, in an exhaust gas passage of an internal combustion engine to generate the steam by utilizing the waste heat of the internal combustion engine. The steam generated in the boiler 6 is fed to the steam inlet 12A of the steam introduction passage 12 through a pipe passage 63.

Next, the operation of the steam engine unit of the invention will be described with reference also to FIG. 3 which is a view illustrating the operation of the rotor 5.

The water in the closed container 1 is pumped by the circulating pump 7 into the boiler 6 where it is heated and transformed into the steam. The generated steam passes through the pipe passage 63 and is fed into the steam introduction passage 12 formed in the boss portion 11. The rotor 5 is rotatably fitted onto the boss portion 11, and inner circumferential surface 51 thereof slides on the slide-contact portions 11A on the outer circumference of the boss portion 11 in contact therewith. The steam feed ports 12B of the steam introduction passage 12 are opened in the slide-contact portions 11A. As shown in FIG. 3, if the opening on the side of the inner circumferential surface of the bent flow path which is one of the bent flow paths 53 formed in the rotor 5 comes into agreement with the steam feed port 12B, the steam flows into the bent flow path 53A. The bent flow path 53A has been filled with the water in the closed container 1, and the steam expands as it passes through the bent flow path 53A and is jetted at a high speed in the state of being mixed with water into the closed container 1 from the end portion of the bent flow path 53A opened in the outer circumferential surface 52 of the rotor 5.

Figure 3:
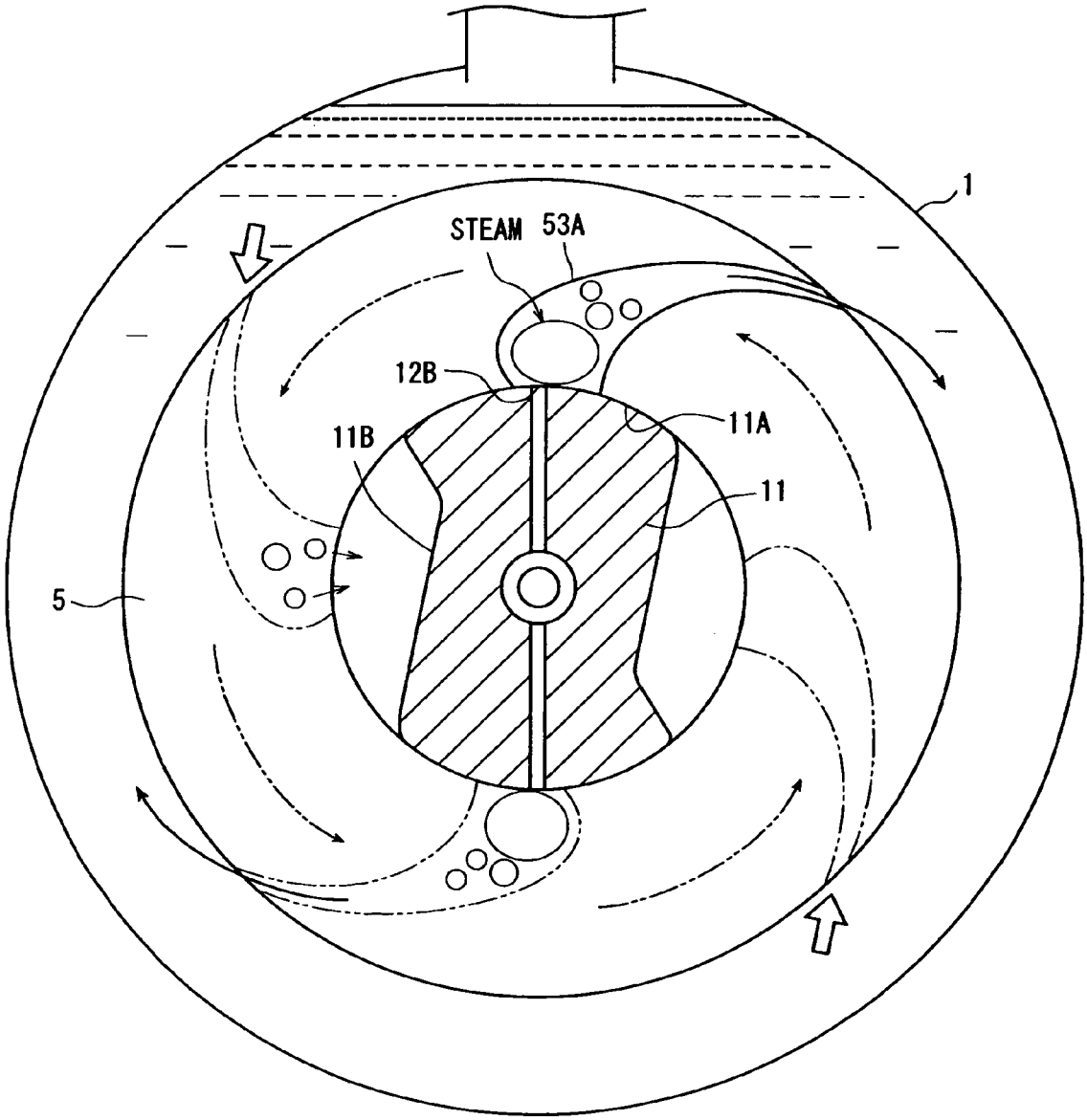
[FIG. 3] is a view illustrating the operation of the steam engine body of the invention.
Figure 4:
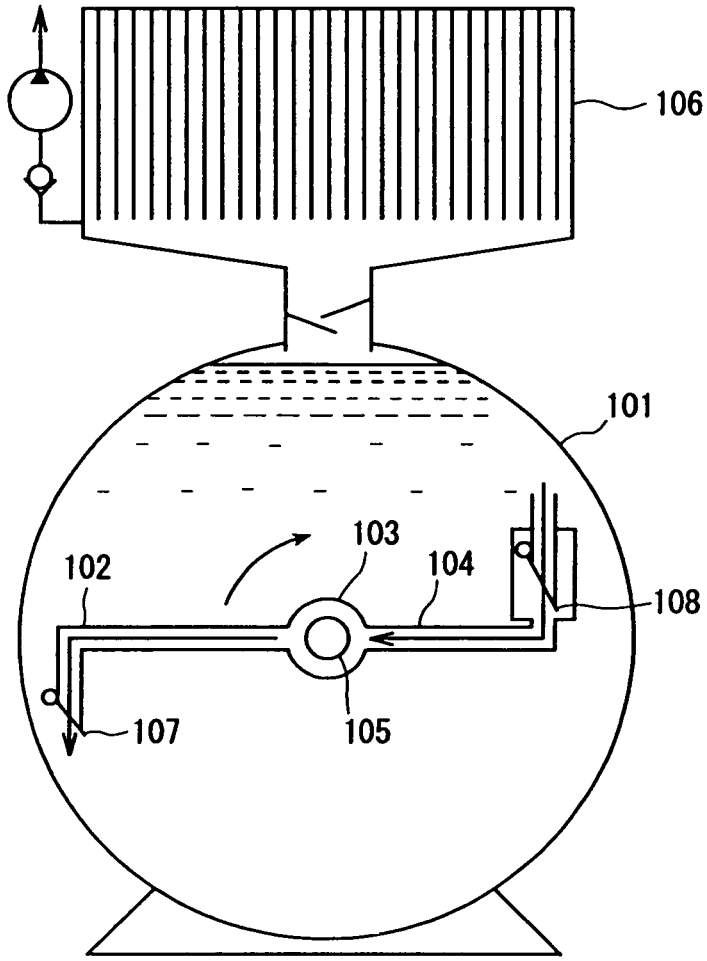
[FIG. 4] is a view showing a conventional steam engine.

A rotational torque acts on the rotor 5 due to the reaction of the mixture jetted from the end portion of the bent flow path 53A, and the rotor rotates counterclockwise in FIG. 3. The jetted mixture contains water which is a liquid in large amounts. Besides, since water has a specific gravity which is very larger than that of the steam, the kinetic amount of the mixture becomes large and a large rotational torque acts on the rotor 5. Therefore, a required power can be taken out even when the rotor 5 rotates at a low speed. The rotational energy (mechanical energy) that accompanies the turn of the rotor 5 can be taken out to the external unit as electric energy relying on the interacting electromagnetic action of the permanent magnets 54 turning together with the rotor 5 and the generating coil 13 being stationary.

As the rotor 5 rotates and the communication is interrupted between the opening of the bent flow path 53A on the side of the inner circumferential surface and the steam feed port 12B, the steam is no longer fed into the bent flow path 53A. In this case, water in the closed container 1 flows reversely into the bent flow path 53A through the opening on the side of the outer circumferential surface 52, and the steam in the bent flow path 53A is cooled by the surrounding water and condenses. The rotor 5 further rotates and the opening of the bent flow path 53A on the side of the inner circumferential surface communicates with the recessed portion 11B. Here, water of a low temperature is present in the recessed portion 11B, and condensation of the steam remaining in the bent flow path 53A is accelerated by the water in the recessed portion 11B and, at the same time, part of the steam flows into the recessed portion 11B. Therefore, at the time when the bent flow path 53A is opened again to the steam feed port 12 B (steam feed port on the lower side in FIG. 3), the remaining steam is substantially disappearing, and the interior of the bent flow path 53A has been filled with the water which is a liquid. Therefore, water is jetted in a decreased amount from the bent flow path 53A, and there is no decrease in the produced rotational torque. Further, the water that reversely flows through the bent flow path 53A toward the recessed portion 11B imparts a torque to the rotor 5 in the direction in which it rotates to assist the torque produced by the jet of the mixture.

The rotor 5 of the steam engine body has a plurality of bent flow paths 53A to D that are extending from the inner circumferential surface 51 to the outer circumferential surface 52 formed in a round shape in cross section, and are evenly arranged in the circumferential direction of the rotor 5. The operation of the bent flow path 53A is similarly and periodically executed by other bent flow paths, too. The rotor 5 has no moving part such as check valve and, therefore, has a structure featuring high reliability without inconvenience caused by the centrifugal force of when the rotor rotates. A plurality of the bent flow paths 53 are evenly arranged in the circumferential direction of the rotor 5. Therefore, the rotor 5 has a point-symmetrical shape in cross section without unbalanced weight, and feature excellent static or dynamic balance as a rotor.

The steam jetted from the rotor 5 rises through the water, is sent through the short pipe 3 into the condenser 2 where it is cooled, condensed and is refluxed into the closed container 1. Radiator fins 21 are provided in the condenser 2, and a check valve 22 and a vacuum pump 23 are connected to the condenser 2 to evacuate the air and the like. Therefore, the pressures in the condenser 2 and in the closed container 1 are lowered and are maintained at a saturated steam pressure. Radiator fins can be, further, provided on the outer surfaces of the condenser 2 as represented by two-dot chain lines in FIG. 1(*b*). In this embodiment, the condenser 2 is communicated as a separate body with the closed container 1. However, it is also allowable to provide radiator fins on the outer surfaces of the closed container 1, too, so that the closed container 1 by itself also works as a condenser.

The water condensed and liquefied in the condenser 2 refluxes into the closed container 1, and is pumped by the circulating pump 7 from the bottom portion of the closed container 1 into the boiler 6. The pumped water is injected in an atomized form into the boiler from the injection nozzle 61 disposed in the boiler 6, and is heated and quickly evaporated. Therefore, the time for evaporating the water is greatly shortened contributing to improving the starting performance of the steam engine unit and attaining quick response even when, for example, the load has increased.

Field of Utilization in Industry

As described above in detail, the steam engine unit of the invention uses a rotor free of unbalanced weight but having a plurality of bent flow paths arranged at regular intervals, the rotor being contained in the closed container filled with the liquid and rotated by the jet of a mixture of the steam generated in the boiler and the liquid through the bent flow paths, and the rotor being, further, so supported that the liquid is smoothly fed into the flow paths of the rotor. Therefore, the steam engine unit of the invention can be utilized as various power sources, such as an engine mounted on a vehicle. In the above embodiment, the heat from the heating unit is converted into rotational energy which is, further, transformed into electric energy and is taken out. However, it needs not be pointed out that the heat can be taken out as rotational energy by coupling a gear device to the rotor. It will be, further, obvious that the embodiment can be variously modified, such as using a refrigerant like Freon in place of water as a liquid to serve as an operation fluid or suitably changing the sectional shape of the recessed portions in the boss portion.

The invention claimed is:

1. A steam engine unit, comprising:

a closed container filled with a liquid;

a rotor dipped in the liquid in said closed container and being rotatably supported therein; and a boiler that heats the liquid in said closed container to generate steam, wherein said rotor comprises an inner circumferential surface formed in a round shape in a cross section and a plurality of bent flow paths extending from said inner circumferential surface to an outer circumferential surface, the plurality of said bent flow paths being evenly arranged in a circumferential direction of said rotor, wherein said closed container comprises a boss portion fixed to a side wall thereof and is protruding into said closed container, and the inner circumferential surface of said rotor is fitted onto said boss portion so that said rotor is rotatably supported thereby, and wherein the outer circumference of said boss portion alternately forms slide-contact portions on where the inner circumferential surface of said rotor slides in contact therewith, and recessed portions from where the inner circumferential surface of said rotor separates away, said slide-contact portions being provided with a steam feed port for introducing the steam generated in said boiler into said rotor.

2. The steam engine unit according to claim 1, wherein a circulating pump is provided to feed the liquid in said closed container to said boiler, an injection nozzle is provided in said boiler, and the liquid in said closed container is injected in an atomized form into the boiler.

3. The steam engine unit according to claim 1, wherein a condenser is provided that communicates with said closed container to condense the steam.

4. The steam engine unit according to claim 2, wherein a condenser is provided that communicates with said closed container to condense the steam.

5. The steam engine unit according to claim 1, wherein the steam in said bent flow paths is cooled after passing through the steam feed port.

6. The steam engine unit according to claim 5, wherein a pressure of the steam decreases after said passing through the steam feed port.

7. The steam engine unit according to claim 6, wherein a pressure difference in the steam causes the liquid in the closed container to flow reversely into said bent flow paths.

8. The steam engine unit according to claim 7, wherein, at a time when one of said bent flow paths encounters one of the recessed portions, steam that is remained in a vicinity of a boss end of said one of said bent flow paths is pushed into said one of the recessed portions by a flow of the liquid.

9. The steam engine unit according to claim 1, wherein said rotor rotates in the liquid.

10. The steam engine unit according to claim 1, wherein the liquid is disposed between the outer circumferential surface of said rotor and an inner surface of said closed container.

11. The steam engine unit according to claim 1, wherein an opening of one of said bent flow paths on a side of the inner circumferential surface communicates with one of the recessed portions such that a condensate of steam that is remained in said one of said bent flow paths is accelerated by water in said one of the recessed portions.

* * * * *